US012714916B2

(12) United States Patent
Madson et al.

(10) Patent No.: US 12,714,916 B2
(45) Date of Patent: Aug. 25, 2026

(54) GOLF BALLS HAVING REDUCED DISTANCE

(71) Applicant: Acushnet Company, Fairhaven, MA (US)

(72) Inventors: Michael Madson, Easton, MA (US); Nicholas Nardacci, Barrington, RI (US); Derek A. Ladd, Acushnet, MA (US)

(73) Assignee: Acushnet Company, Fairhaven, MA (US)

( * ) Notice: Subject to any disclaimer, the term of this patent is extended or adjusted under 35 U.S.C. 154(b) by 284 days.

(21) Appl. No.: 17/863,569

(22) Filed: Jul. 13, 2022

(65) Prior Publication Data

US 2023/0135518 A1 May 4, 2023

Related U.S. Application Data

(62) Division of application No. 17/516,824, filed on Nov. 2, 2021.

(51) Int. Cl.
*A63B 37/00* (2006.01)

(52) U.S. Cl.
CPC ..... *A63B 37/0006* (2013.01); *A63B 37/0019* (2013.01); *A63B 37/002* (2013.01); *A63B 37/0021* (2013.01); *A63B 37/0061* (2013.01)

(58) Field of Classification Search
CPC ..... A63B 37/0006–00065
See application file for complete search history.

(56) References Cited

U.S. PATENT DOCUMENTS 4,141,559 A * 2/1979 Melvin ..... A63B 37/0021 473/379
4,142,727 A * 3/1979 Shaw ..... A63B 37/0074 473/383
4,560,168 A * 12/1985 Aoyama ..... A63B 37/0004 D21/709
4,729,567 A * 3/1988 Oka ..... A63B 37/0018 473/384
4,762,326 A 8/1988 Gobush
4,804,189 A * 2/1989 Gobush ..... A63B 37/0004 473/379
4,844,472 A * 7/1989 Ihara ..... A63B 37/0016 473/379
4,867,459 A * 9/1989 Ihara ..... A63B 37/0009 473/379
4,869,512 A 9/1989 Nomura et al.
(Continued)

OTHER PUBLICATIONS

Examiner's Calculations, uploaded Jan. 5, 2023, Excel Spreadsheet, 1 page.*

*Primary Examiner* — Michael D Dennis
*Assistant Examiner* — Matthew B Stanczak
(74) *Attorney, Agent, or Firm* — Bradley Arant Boult Cummings LLP

(57) ABSTRACT

Golf balls having core formulations including polybutadiene, butyl rubber, or a blend thereof, and low surface coverage dimple patterns are disclosed. The combination of low surface coverage with particular rubber formulations helps to reduce the flight of the ball while also providing improved aerodynamic consistency and maintaining the appearance of a high-performance trajectory.

5 Claims, 3 Drawing Sheets

(56) References Cited

U.S. PATENT DOCUMENTS 4,915,390 A * 4/1990 Gobush ..... A63B 37/0004 473/379
4,949,976 A * 8/1990 Gobush ..... A63B 37/0006 473/379
4,960,283 A * 10/1990 Gobush ..... A63B 37/0083 473/384
5,009,428 A 4/1991 Yamagishi et al.
5,016,887 A * 5/1991 Jonkouski ..... A63B 37/0004 473/379
5,018,741 A 5/1991 Stiefel et al.
5,060,954 A * 10/1991 Gobush ..... A63B 37/0004 473/379
5,087,049 A 2/1992 Yamagishi et al.
5,209,485 A * 5/1993 Nesbitt ..... A63B 37/0078 473/372
5,377,989 A 1/1995 Machin
5,507,493 A * 4/1996 Sullivan ..... A63B 37/0065 473/383
5,544,889 A 8/1996 Moon
5,562,552 A * 10/1996 Thurman ..... A63B 37/0004 473/379
5,564,708 A 10/1996 Hwang
5,569,100 A * 10/1996 Molitor ..... A63B 37/00065 473/384
5,575,477 A * 11/1996 Hwang ..... A63B 37/002 473/379
5,662,530 A 9/1997 Sellar
5,688,193 A * 11/1997 Kasasima ..... A63B 37/0006 425/408
5,688,194 A 11/1997 Stiefel et al.
5,890,974 A 4/1999 Stiefel et al.
5,935,023 A * 8/1999 Maehara ..... A63B 37/009 473/379
5,957,786 A * 9/1999 Aoyama ..... A63B 37/0006 473/379
5,957,787 A * 9/1999 Hwang ..... A63B 37/002 473/379
6,056,650 A 5/2000 Yamagishi et al.
6,200,232 B1 * 3/2001 Kasashima ..... A63B 37/0006 473/379
6,241,627 B1 * 6/2001 Kasashima ..... A63B 37/00065 473/378
6,358,161 B1 * 3/2002 Aoyama ..... A63B 37/0018 473/383
6,609,983 B2 8/2003 Winfield
6,729,976 B2 * 5/2004 Bissonnette ..... A63B 37/0026 473/383
6,774,187 B2 8/2004 Voorheis et al.
6,796,912 B2 9/2004 Dalton et al.
6,982,301 B1 1/2006 Voorheis et al.
7,048,652 B2 5/2006 Sato et al.
7,322,892 B1 * 1/2008 Watanabe ..... A63B 37/00621 473/373
7,503,856 B2 3/2009 Nardacci et al.
7,815,527 B2 10/2010 Sullivan et al.
7,951,017 B2 5/2011 Umezawa
8,152,656 B2 4/2012 Sullivan et al.
8,512,166 B2 * 8/2013 Sullivan ..... A63B 37/0003 473/378
8,821,317 B2 9/2014 Umezawa
9,440,119 B2 * 9/2016 Sullivan ..... A63B 37/0075
9,782,630 B2 10/2017 Madson et al.
9,839,813 B2 12/2017 Squires et al.
10,183,195 B2 * 1/2019 Madson ..... A63B 37/0004
10,532,252 B2 1/2020 Madson et al.
10,668,327 B2 6/2020 Madson et al.
10,758,783 B1 * 9/2020 Madson ..... A63B 37/0012
10,814,175 B2 10/2020 Madson et al.
10,814,179 B1 * 10/2020 Madson ..... A63B 37/002
11,045,692 B2 6/2021 Madson
11,167,174 B1 * 11/2021 Madson ..... A63B 37/0021
11,406,876 B2 8/2022 Madson et al.
2001/0024983 A1 * 9/2001 Morgan ..... A63B 37/00065 473/378
2003/0045378 A1 * 3/2003 Bissonnette ..... A63B 37/00215 473/378
2003/0080469 A1 5/2003 Endo et al.
2004/0132549 A1 * 7/2004 Aoyama ..... A63B 37/0091 473/378
2004/0209709 A1 * 10/2004 Sato ..... A63B 37/0019 473/378
2005/0143194 A1 6/2005 Sato et al.
2006/0019772 A1 * 1/2006 Sullivan ..... A63B 37/0021 473/378
2007/0049423 A1 * 3/2007 Nardacci ..... A63B 37/0021 473/378
2007/0093319 A1 * 4/2007 Sullivan ..... A63B 37/00065 473/371
2007/0135234 A1 6/2007 Nagasawa
2007/0259739 A1 11/2007 Kasashima et al.
2008/0125249 A1 * 5/2008 Sajima ..... A63B 37/0019 473/379
2008/0220907 A1 * 9/2008 Aoyama ..... A63B 37/002 473/383
2009/0023519 A1 1/2009 Sullivan et al.
2009/0098951 A1 * 4/2009 Sullivan ..... A63B 37/009 473/378
2009/0124428 A1 5/2009 Sullivan et al.
2010/0075776 A1 * 3/2010 Nardacci ..... A63B 37/0096 473/371
2011/0065531 A1 3/2011 Goodwin
2012/0302378 A1 * 11/2012 Sato ..... A63B 37/0039 473/383
2013/0172123 A1 7/2013 Nardacci et al.
2013/0172125 A1 7/2013 Nardacci et al.
2014/0113751 A1 4/2014 Sullivan et al.
2014/0135146 A1 5/2014 Madson et al.
2014/0364253 A1 12/2014 Sullivan et al.
2015/0306461 A1 10/2015 Parsons et al.
2016/0107036 A1 4/2016 Madson et al.
2016/0107037 A1 4/2016 Parsons et al.
2017/0246509 A1 8/2017 Madson et al.
2018/0311533 A1 11/2018 Madson et al.
2019/0070465 A1 3/2019 Hwang et al.
2020/0338395 A1 10/2020 Madson et al.
2021/0093928 A1 * 4/2021 Madson ..... A63B 37/0008
2021/0138305 A1 5/2021 Engle et al.
2022/0072385 A1 * 3/2022 Engle ..... A63B 37/0007
2022/0161097 A1 5/2022 Madson et al.
2022/0161098 A1 * 5/2022 Madson ..... A63B 37/0006
2022/0161099 A1 * 5/2022 Madson ..... A63B 37/0006
2022/0161100 A1 * 5/2022 Madson ..... A63B 37/0021
2022/0176204 A1 * 6/2022 Madson ..... A63B 37/002
2023/0050722 A1 * 2/2023 Madson ..... A63B 37/002
2023/0134882 A1 * 5/2023 Madson ..... A63B 37/0006 473/383
2023/0135518 A1 * 5/2023 Madson ..... A63B 37/0006 473/383
2023/0136559 A1 * 5/2023 Madson ..... A63B 37/0006 473/383
2025/0161758 A1 * 5/2025 Madson ..... A63B 37/0006

* cited by examiner

GOLF BALLS HAVING REDUCED DISTANCE

FIELD OF THE INVENTION

The present disclosure relates generally to golf balls. More particularly, the present disclosure relates to limited flight golf balls having low coverage dimple patterns and core formulations having low percentages of polybutadiene, butyl rubber, or blends thereof.

BACKGROUND OF THE INVENTION

The flight performance of a golf ball is affected by a variety of factors including the weight, size, materials, dimple pattern, and external shape of the golf ball. Golf ball manufacturers seek to maximize aerodynamic efficiency and improve the performance of golf balls by adjusting the materials and construction of the ball as well as the dimple pattern and dimple shape.

The aerodynamic forces acting on a golf ball are typically resolved into orthogonal components of lift ($F_L$) and drag ($F_D$). Lift is defined as the aerodynamic force component acting perpendicular to the flight path. It results from a difference in pressure that is created by a distortion in the air flow that results from the back spin of the ball. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Drag is defined as the aerodynamic force component acting parallel to the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. The air separates from the surface of the ball, leaving a large turbulent flow area with low pressure, i.e., the wake. The difference between the high pressure in front of the ball and the low pressure behind the ball reduces the ball speed and acts as the primary source of drag.

Recently, there has been an increased desire to manipulate these aerodynamic forces to produce reduced-flight golf balls (i.e., golf balls that are designed to travel a distance that is shorter than the distance traveled by standard golf balls). Advances in golf ball compositions and dimple designs have caused high-performance golf balls to exceed the maximum distance allowed by the United States Golf Association (USGA). Some industry experts have called for the USGA to roll back the distance standard for golf balls to preserve the game.

Golf ball manufacturers have developed ways to reduce the distance traveled by the golf ball. For example, some manufacturers have created inefficient dimple patterns or have modified the compositions of the golf ball core to reduce the flight of the ball. Inefficient dimple patterns with low surface coverages have been used for many years. For example, the Atti pattern, which is an octahedron pattern split into eight concentric straight-line rows and covering 66 percent of the ball, was the predominant pattern utilized on golf balls for most of the $20^{th}$ century. These dimple patterns were composed of substantially uniform dimples (for example, dimples having only one or two dimple diameters) and lacked aerodynamic efficiency. As dimple designers moved toward patterns with increased surface coverages, many more dimple sizes (for example, dimple diameters) were needed to achieve increased coverages and improved aerodynamics, such as increased distance. While these high-performance golf balls have improved aerodynamic consistency, the golf balls will not adhere to a shorter USGA maximum distance.

Accordingly, there remains a need to fine-tune the dimple patterns and the golf ball compositions of these high-performance golf balls to reduce the flight distance, while also maintaining the appearance of a high-performance trajectory.

SUMMARY OF THE INVENTION

In some embodiments of the present disclosure, a golf ball is provided, the golf ball including a core layer including a rubber formulation of polybutadiene rubber, butyl rubber, or a blend thereof, and a cover layer including a plurality of dimples disposed thereon, wherein the dimples are arranged in a tetrahedral pattern including four substantially identical dimple sections, wherein each dimple section is defined by a spherical triangle, wherein the dimples in each of the four substantially identical dimple sections have a corresponding dimple diameter and a corresponding edge angle and the dimples in each of the four substantially identical dimple sections include: (i) at least three different dimple diameters including a minimum dimple diameter, a maximum dimple diameter, and at least one additional dimple diameter, wherein each of the at least three different dimple diameters range from about 0.030 inches to about 0.200 inches, and (ii) substantially identical edge angles, and wherein the pattern has a surface coverage of about 65 percent or less and the pattern results in at least three dimple-free great circles on the golf ball, and wherein the surface coverage is related to the amount of polybutadiene rubber present in the rubber formulation according to the following equation:

$$\frac{BR}{1-SC} \leq 2.0$$

where SC is the surface coverage in the decimal form of percentage and $0<SC<1$, and BR is the weight percent of polybutadiene rubber, in decimal form, based on the total weight of rubber in the rubber formulation and $0 \leq BR \leq 1$.

In this embodiment, the rubber formulation may include a blend of polybutadiene rubber and butyl rubber. In other embodiments, the golf ball has a coefficient of restitution (COR) of about 0.780 or less, for example, about 0.740 or less. In still other embodiments, the average of all the edge angles ($\theta_\mu$) is related to the surface coverage according to the following equation:

$$88.8(SC)^2 - 116.9(SC) + 47.7 \leq \theta_\mu \leq 170.0(SC)^2 - 242.5(SC) + 106.6$$

where SC is the surface coverage in the decimal form of percentage and $0<SC<1$. In yet other embodiments, the golf ball has an initial velocity and the initial velocity is related to the surface coverage according to the following equation:

$$\frac{IV}{1-SC} \leq 700$$

where IV is the initial velocity in ft/sec and SC is the surface coverage in the decimal form of percentage and 0<SC<1.

In other embodiments of the present disclosure, a golf ball is provided, the golf ball including a core layer including a rubber formulation of polybutadiene rubber, butyl rubber, or a blend thereof, and a cover layer including a plurality of dimples disposed thereon, wherein the dimples are arranged in a dipyramid pattern selected from the group consisting of triangular dipyramid, quadrilateral dipyramid, pentagonal dipyramid, and hexagonal dipyramid, the dipyramid pattern including six, eight, ten, or twelve substantially identical dimple sections, wherein each dimple section is defined by a spherical triangle having three vertices, wherein the dimples in each of the substantially identical dimple sections have a corresponding dimple diameter and a corresponding edge angle and the dimples in each of the substantially identical dimple sections include: (i) at least three different dimple diameters including a minimum dimple diameter, a maximum dimple diameter, and at least one additional dimple diameter, wherein each of the at least three different dimple diameters range from about 0.030 inches to about 0.200 inches, and (ii) substantially identical edge angles, and wherein the pattern has a surface coverage of about 65 percent or less and the pattern results in one dimple free great circle on the golf ball, and wherein the surface coverage is related to an amount of the rubber formulation according to the following equation:

$$\frac{BR}{1-SC} \leq 2.0$$

where SC is the surface coverage in the decimal form of percentage and 0<SC<1, and BR is the weight percent of polybutadiene rubber, in decimal form, based on the total weight of rubber in the rubber formulation and 0≤BR≤1.

In this embodiment, the rubber formulation may include a blend of polybutadiene rubber and butyl rubber in a ratio of about 30:70 to about 70:30. In other embodiments, the golf ball has a coefficient of restitution (COR) of about 0.780 or less, for example, about 0.740 or less. In still other embodiments, the average of all the edge angles ($\theta_\mu$) is related to the surface coverage according to the following equation:

$$88.8(SC)^2 - 116.9(SC) + 47.7 \leq \theta_\mu \leq 170.0(SC)^2 - 242.5(SC) + 106.6$$

where SC is the surface coverage in the decimal form of percentage and 0<SC<1. In further embodiments, the golf ball includes an initial velocity and the initial velocity is related to the surface coverage according to the following equation:

$$\frac{IV}{1-SC} \leq 600$$

where IV is the initial velocity in ft/sec and SC is the surface coverage in the decimal form of percentage and 0<SC<1.

In still other embodiments of the present disclosure, a golf ball is provided, the golf ball including a core layer including a rubber formulation of polybutadiene rubber, butyl rubber, or a blend thereof, and a cover layer including a plurality of dimples disposed thereon, wherein the dimples are arranged in an octahedral pattern including eight substantially identical dimple sections, wherein each dimple section is defined by a spherical triangle, wherein the dimples in each of the eight substantially identical dimple sections have a corresponding dimple diameter and a corresponding edge angle and the dimples in each of the eight substantially identical dimple sections include: (i) at least three different dimple diameters including a minimum dimple diameter, a maximum dimple diameter, and at least one additional dimple diameter, wherein each of the at least three different dimple diameters range from about 0.030 inches to about 0.200 inches, and (ii) substantially identical edge angles, and wherein the pattern has a surface coverage of about 65 percent or less and the pattern results in at least four dimple free great circles on the golf ball, and wherein the surface coverage is related to an amount of the rubber formulation according to the following equation:

$$\frac{BR}{1-SC} \leq 2.0$$

where SC is the surface coverage in the decimal form of percentage and 0<SC<1, and BR is the weight percent of polybutadiene rubber, in decimal form, based on the total weight of rubber in the rubber formulation and 0≤BR≤1.

In some embodiments, the golf ball has a coefficient of restitution and the coefficient of restitution is related to the surface coverage according to the following equation:

$$\frac{COR}{1-SC} \leq 2.0$$

where COR is the coefficient of restitution and 0<COR<1, and SC is the surface coverage in the decimal form of percentage and 0<SC<1. In other embodiments, the average of all the edge angles ($\theta_\mu$) is related to the surface coverage according to the following equation:

$$88.8(SC)^2 - 116.9(SC) + 47.7 \leq \theta_\mu \leq 170.0(SC)^2 - 242.5(SC) + 106.6$$

where SC is the surface coverage in the decimal form of percentage and 0<SC<1. In still other embodiments, the rubber formulation includes a blend of polybutadiene rubber and butyl rubber in a ratio of about 40:60 to about 60:40. In further embodiments, the golf ball includes an initial velocity and the initial velocity is related to the surface coverage according to the following equation:

$$\frac{IV}{1-SC} \leq 500$$

where IV is the initial velocity in ft/sec and SC is the surface coverage in the decimal form of percentage and 0<SC<1.

In yet other embodiments of the present disclosure, a golf ball is provided, the golf ball including a core layer including a rubber formulation of polybutadiene rubber, butyl rubber, or a blend thereof, and a cover layer including a plurality of dimples disposed thereon, a plurality of dimples disposed thereon, wherein the dimples are arranged in an icosahedral pattern including twenty substantially identical dimple sections, wherein each dimple section is defined by a spherical triangle, wherein the dimples in each of the twenty substantially identical dimple sections have a corresponding dimple diameter and a corresponding edge angle and the dimples in each of the twenty substantially identical dimple sections include: (i) at least four different dimple diameters including a minimum dimple diameter, a maximum dimple diameter, and at least two additional dimple diameters, wherein each of the at least four different dimple diameters range from about 0.030 inches to about 0.200 inches, and (ii) substantially identical edge angles, and wherein the pattern has a surface coverage of about 65 percent or less and the pattern results in at least five dimple free great circles on the golf ball, and wherein the surface coverage is related to an amount of the rubber formulation according to the following equation:

$$\frac{BR}{1-SC} \leq 2.0$$

where SC is the surface coverage in the decimal form of percentage and $0<SC<1$, and BR is the weight percent of polybutadiene rubber, in decimal form, based on the total weight of rubber in the rubber formulation and $0 \leq BR \leq 1$.

In some embodiments, the rubber formulation includes butyl rubber. In other embodiments, the rubber formulation includes a blend of polybutadiene rubber and butyl rubber in a ratio of about 30:70 to about 70:30. In still other embodiments, the golf ball has a coefficient of restitution and the coefficient of restitution is related to the surface coverage according to the following equation:

$$\frac{COR}{1-SC} \leq 1.75$$

where COR is the coefficient of restitution and $0<COR<1$, and SC is the surface coverage in the decimal form of percentage and $0<SC<1$. In further embodiments, the golf ball has an initial velocity of about 246 ft/sec or less, for example, about 240 ft/sec or less.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
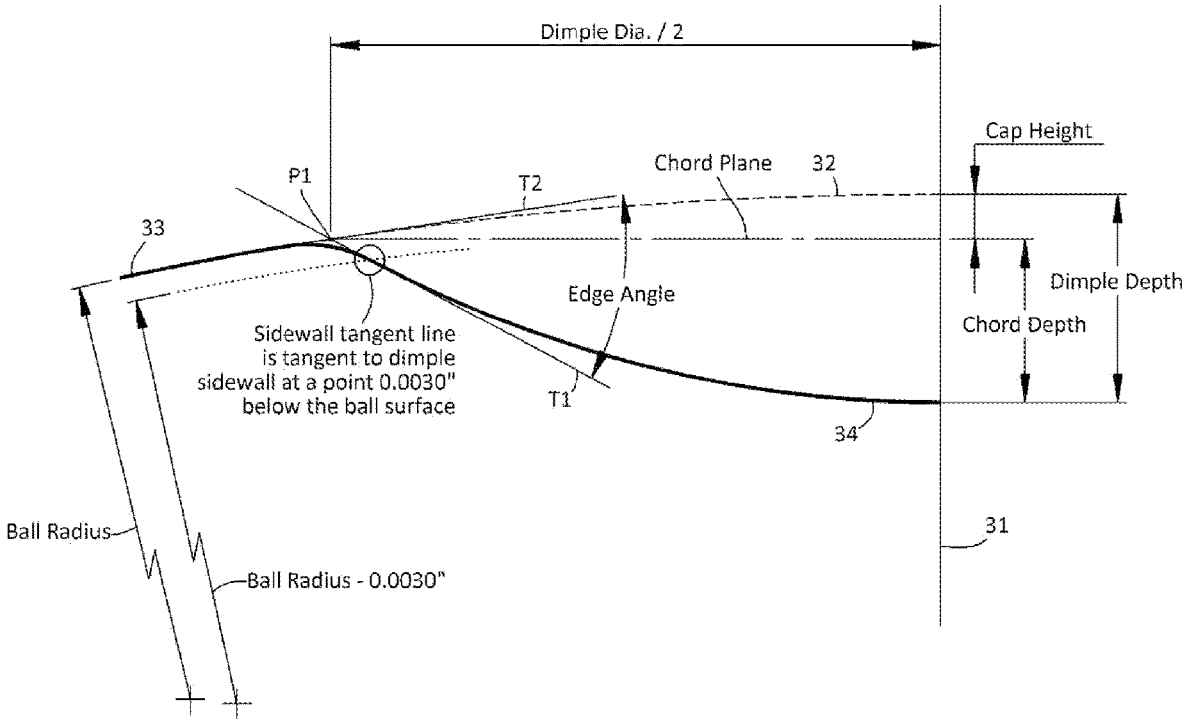
FIG. 1 is a schematic diagram illustrating a method for measuring the diameter of a dimple.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

The present disclosure provides reduced-flight golf balls. That is, golf balls designed to travel a distance that is shorter than the distance traveled by current performance balls. The distance that a golf ball will travel upon impact by a golf club is a function of the coefficient of restitution (COR), the weight, and the aerodynamic characteristics of the ball, which among other things are affected by one or more factors, such as the size, dimple coverage, dimple size, dimple shape, and composition of the various layers in the golf ball including the core. The golf balls of the present disclosure include center components, such as core and intermediate layers, formed from formulations having a low percentage of polybutadiene or butyl rubber and covers with dimple patterns designed to limit the aerodynamic performance of the golf ball (for example, a low surface coverage dimple pattern). The novel golf balls achieve a reduction in overall distance when compared to a conventional golf ball hit under the same conditions. Advantageously, the combination of a dimple pattern with low surface coverage and a core with a percentage of butyl rubber restricts flight while also providing aerodynamic consistency and an appearance of a high-performance trajectory.

Dimple Patterns

In some embodiments, the golf balls of the present disclosure utilize dimple patterns designed to achieve a reduction in overall distance when compared to a conventional golf ball. One way to achieve such a dimple pattern is to utilize a dimple pattern having a low percentage of surface coverage. As used herein, "surface coverage" refers to the percentage of the ball surface that has been removed by the formation of dimples. In other words, the surface coverage is the surface area of a sphere having the diameter of the golf ($D_{ball}$) minus the surface area of the fret area of the golf ball. By reducing the surface coverage of dimples on the ball, the flight and distance of the golf ball can be reduced.

Surface coverage may be calculated using equation (I):

$$\text{Surface Coverage} = \frac{\sum_{i=1}^{n} \pi\left(r_i^2 + h_i^2\right)}{4\pi\left(\frac{D_{ball}}{2}\right)^2}, \quad \text{(I)}$$

where n is the number of dimples on the ball, r is the dimple plan shape radius (equal to the dimple diameter/2), and h is the cap height.

In one embodiment, the dimple patterns utilized with a golf ball of the present disclosure have a surface coverage of less than about 70 percent. In another embodiment, golf balls according to the present invention have a dimple pattern with a surface coverage of less than about 65 percent. In another embodiment, the dimple patterns utilized with the golf balls of the present disclosure have a surface coverage of less than about 60 percent. In still another embodiment, golf balls of the present invention employ dimple patterns having a surface coverage of less than about 50 percent. In yet another embodiment, the dimple patterns utilized with golf balls in accordance with the present disclosure have a surface coverage of less than about 40 percent. In another embodiment, the dimple patterns utilized with golf balls in accordance with the present disclosure have a surface coverage of less than about 30 percent. In still another embodiment, golf balls of the present invention employ dimple patterns having a surface coverage of less than about 20 percent. In yet another embodiment, the dimple patterns utilized with the golf balls of the present disclosure have a surface coverage of about 15 percent.

The dimple patterns may be arranged in any type of layout that results in a correspondingly low dimple surface coverage (for instance, a surface coverage of less than 70 percent, and preferably less than 65 percent). As will be discussed in more detail below, suitable dimple layouts for golf balls made in accordance with the present disclosure include, but are not limited to, tetrahedral layouts, such as those described in U.S. application Ser. No. 16/953,507, filed on Nov. 20, 2020, the entire disclosure of which is incorporated herein by reference; dipyramid layouts, such as those described in U.S. application Ser. No. 16/953,540, filed on Nov. 20, 2020, the entire disclosure of which is incorporated herein by reference; octahedral layouts, such as those described in U.S. application Ser. No. 16/953,552, filed on Nov. 20, 2020, the entire disclosure of which is incorporated herein by reference; and icosahedral layouts, such as those described in U.S. application Ser. No. 16/953,528, filed on Nov. 20, 2020, the entire disclosure of which is incorporated herein by reference.

Tetrahedral Dimple Patterns

In one embodiment, golf ball dimple patterns utilized with golf balls according to the present disclosure are arranged in a tetrahedral layout. The golf ball dimple patterns are arranged in a tetrahedral layout such that there are four identical sections on the golf ball. In one embodiment, each section is in the shape of a spherical triangle. As used herein, "spherical triangle" refers to a figure formed on the surface of a sphere by three circular arcs intersecting pairwise at three vertices. The three circular arcs each represent an edge of the spherical triangle.

The dimples may be located entirely within a dimple section. For example, in one embodiment, the dimples may be arranged within the edges of the spherical triangle such that no dimples intersect an edge of the spherical triangle. In another embodiment, dimples may be shared between two or more dimples sections. In one aspect of this embodiment, for each dimple that is not located entirely within a dimple section, the centroid of the dimple is located along a side edge or at one or more vertices of the spherical triangle. In another aspect of this embodiment, dimples shared between two sections may include dimples that are positioned such that the centroid of the dimple does not lie along a side edge. For purposes of the present disclosure, the "centroid" of the dimple refers to the center of the dimple.

In one embodiment, the dimple pattern within each of the four identical dimple sections may be arranged such that one or more dimples intersect an edge of the spherical triangle. In a particular aspect of this embodiment, the edge intersected by the one or more dimples runs through the centroid of the dimple such that half of the dimple is located within one spherical triangle and the other half is located within another spherical triangle. In another aspect of this embodiment, the edge intersected by one or more dimples does not run through the centroid of the dimple. That is, less than half of the dimple is located within one spherical triangle and more than half of the dimple is located within an adjacent spherical triangle. In one embodiment, the dimple pattern within each of the four identical dimple sections includes at least three dimples that intersect an edge of the spherical triangle. In another embodiment, the dimple pattern within each of the four identical dimple sections includes at least six dimples that intersect an edge of the spherical triangle. In another embodiment, the dimple pattern within each of the four identical dimple sections includes at least twelve dimples that intersect an edge of the spherical triangle. In another embodiment, the dimple pattern within each of the four identical dimple sections includes at least fifteen dimples that intersect an edge of the spherical triangle.

In another embodiment, the tetrahedral dimple patterns may be arranged such that a dimple lies at one or more vertices of the spherical triangle. In this embodiment, the centroid of the dimple is located at the vertex of the spherical triangle and a portion of the dimple is located within three of the spherical triangles. That is, the dimple located at the vertex of the spherical triangle may be centered on the vertices of the spherical triangles. The dimple patterns of the present disclosure may include a dimple located at a single vertex of the spherical triangle. In another embodiment, the dimple patterns may include a dimple located at each of two vertices of the spherical triangle. In still another embodiment, the dimple patterns may include a dimple located at each of the three vertices of the spherical triangle.

The dimple patterns arranged in each of the dimple sections, for example, in each of the four spherical triangles, are substantially identical to each other. For purposes of the present disclosure, dimple patterns are "substantially identical" if they have substantially the same dimple arrangement (i.e., the relative positions of each of the dimples' centroids are about the same) and substantially the same dimple characteristics (e.g., plan shape, cross-sectional shape, diameter, edge angle). Thus, for each dimple located entirely within a particular dimple section, for example, a particular spherical triangle, there is a corresponding dimple in each of the other three dimple sections. For dimples having a centroid located along an edge of the dimple section, there is a corresponding dimple located along the same edge in the other three dimple sections. For dimples located at the one or more vertices of the dimple sections, these dimples are shared between the other dimple sections.

The dimple patterns within each dimple section, for example, within each of the four spherical triangles, include dimples having varying dimple diameters. In one embodiment, each dimple pattern has at least three different dimple diameters, including a minimum diameter dimple, a maximum diameter dimple, and at least one additional diameter dimple. For purposes of the present disclosure, dimples having substantially different diameters include dimples on a finished ball having respective diameters that differ by 0.005 inches or more. In another embodiment, each dimple pattern has at least four different dimple diameters, including a minimum diameter dimple, a maximum diameter dimple, and at least two additional diameter dimples. In still another embodiment, each dimple pattern has at least five different dimple diameters, including a minimum diameter dimple, a maximum diameter dimple, and at least three additional diameter dimples. In yet another embodiment, each dimple pattern has at least six different dimple diameters, including a minimum diameter dimple, a maximum diameter dimple, and at least four additional diameter dimples.

In one embodiment, each dimple has a dimple diameter of about 0.030 inches to about 0.200 inches. In another embodiment, each dimple has a dimple diameter of about 0.050 inches to about 0.180 inches. In still another embodiment, each dimple has a dimple diameter of about 0.070 inches to about 0.160 inches. In yet another embodiment, each dimple has a dimple diameter of about 0.090 inches to about 0.140 inches.

The minimum and maximum differences between any two dimple diameters within a dimple section may vary. In one embodiment, the minimum difference between any two dimple diameters within a dimple section is about 0.030 inches or more. In another embodiment, the minimum difference between any two dimple diameters within a dimple section is about 0.040 inches or more. In other embodiments, the maximum difference between any two dimple diameters within a dimple section is about 0.055 inches or less. In another embodiment, the maximum difference between any two dimple diameters within a dimple section is about 0.045 inches or less. For instance, the difference between any two dimple diameters within each dimple section is about 0.030 inches to about 0.055 inches.

In some embodiments, the tetrahedral dimple pattern includes at least one dimple intersecting an edge of the dimple section. In this embodiment, at least one dimple having the minimum dimple diameter intersects the edge of the dimple section. In another embodiment, at least one dimple having the maximum dimple diameter intersects the edge of the dimple section. In still another embodiment, at least one dimple having neither the minimum nor maximum dimple diameter intersects the edge of the dimple section. Additionally, in some embodiments, the dimple pattern includes at least one dimple lying at a vertex of the dimple section. In this aspect, at least one dimple having the maximum dimple diameter is located at a vertex of the dimple section.

In one embodiment, the tetrahedral dimple patterns disclosed herein may be symmetric. For example, the dimple patterns within each dimple section may be rotationally symmetric about the central point of each dimple section. That is, the dimple patterns may have three-way rotational symmetry about an axis connecting the center of the golf ball and the central point of the dimple section. In another embodiment, the dimple patterns may have mirror symmetry about a central plane of each dimple section, where the central plane is a plane containing the center of the golf ball, the central point of the corresponding dimple section, and one vertex of the corresponding dimple section.

In one embodiment, the dimples should be arranged within each dimple section such that the outer surface of the golf ball has dimple free great circles. A golf ball having a "dimple free great circle" refers to a golf ball having an outer surface that contains a great circle which does not intersect any dimples. In mathematical terms, every dimple free great circle follows a path on the surface of a golf ball having a given width, and within the given width, there exists an infinite number of great circles. However, for purposes of the present disclosure, each dimple free great circle traverses a different dimple free path in the dimple pattern than another dimple free great circle.

In one embodiment, the dimples may be arranged within each of the four dimple sections such that there are three dimple-free great circles on the outer surface of the golf ball. In another embodiment, the dimples may be arranged within each dimple section such that there are two dimple-free great circles on the outer surface of the golf ball. In yet another embodiment, the dimples may be arranged within each dimple section such that there is one dimple-free great circle on the outer surface of the golf ball.

The dimples may be positioned within each of the four dimple sections according to any packing method known in the art so long as the dimple sections are substantially identical and meet the symmetry and surface coverage requirements discussed herein. For example, the dimples may be arranged within each dimple section according to the methods described in pending U.S. application Ser. No. 16/785,624, filed on Feb. 9, 2020, the entire disclosure of which is incorporated herein by reference.

Dipyramid Dimple Patterns

In another embodiment, dimple patterns utilized with the golf balls according to the present disclosure are arranged in dipyramid layouts. According to the dipyramid layouts, there are two identical hemispheres on the golf ball separated by an equator. Each hemisphere may include three, four, five, or six triangular segments such that there are six, eight, ten, or twelve identical sections, respectively, on the golf ball. In one embodiment, each section is in the shape of a spherical triangle. The three circular arcs each represent an edge of the spherical triangle. In some embodiments, each spherical triangle has a base edge located at the equator of the golf ball and two side edges that run longitudinally from the base edge to the pole of the hemisphere. A spherical triangle in the northern hemisphere may be joined with a spherical triangle in the southern hemisphere at their base edges to form a "dipyramid."

In one embodiment, the golf ball dimple patterns may be arranged in a triangular dipyramid layout such that there are three spherical triangles on each of the two hemispheres of the golf ball. In this embodiment, the triangular dipyramid layout includes a total of six identical dimple sections on the golf ball. In another embodiment, the golf ball dimple patterns may be arranged in a quadrilateral dipyramid layout such that there are four spherical triangles on each of the two hemispheres of the golf ball. In this embodiment, the quadrilateral dipyramid layout includes a total of eight identical dimple sections on the golf ball. In still another embodiment, the golf ball dimple patterns may be arranged in a pentagonal dipyramid layout such that there are five spherical triangles on each of the two hemispheres of the golf ball. In this embodiment, the pentagonal dipyramid layout includes a total of ten identical dimple sections on the golf ball. In yet another embodiment, the golf ball dimple patterns may be arranged in a hexagonal dipyramid layout such that there are six spherical triangles on each of the two hemispheres of the golf ball. In this embodiment, the hexagonal dipyramid layout includes a total of twelve identical dimple sections on the golf ball.

In one embodiment, the dimples may be located entirely within a dimple section. For example, the dimples may be arranged within the edges of the spherical triangle such that no dimples intersect an edge of the spherical triangle. In another embodiment, dimples may be shared between two or more dimples sections. In one aspect of this embodiment, for each dimple that is not located entirely within a dimple section, the centroid of the dimple is located along a side edge or at one or more vertices of the spherical triangle. In another aspect of this embodiment, dimples shared between two sections may include dimples that are positioned such that the centroid of the dimple does not lie along a side edge. For purposes of the present disclosure, the "centroid" of the dimple refers to the center of the dimple. In other embodiments, the base edges of the dimple sections are defined such that no dimples intersect the base edge.

In one embodiment, the dimple pattern within each of the dimple sections may be arranged such that one or more dimples intersect a side edge of the spherical triangle. In a particular aspect of this embodiment, the side edge intersected by the one or more dimples runs through the centroid of the dimple such that half of the dimple is located within one spherical triangle and the other half is located within another spherical triangle. In another aspect of this embodiment, the side edge intersected by one or more dimples does not run through the centroid of the dimple. That is, less than half of the dimple is located within one spherical triangle and more than half of the dimple is located within an adjacent spherical triangle. In one embodiment, the dimple pattern within each of the dimple sections includes at least three dimples that intersect a side edge of the spherical triangle. In another embodiment, the dimple pattern within each of the dimple sections includes at least six dimples that intersect a side edge of the spherical triangle. In another embodiment, the dimple pattern within each of the dimple sections includes at least twelve dimples that intersect a side edge of the spherical triangle. In another embodiment, the dimple pattern within each of the dimple sections includes at least fifteen dimples that intersect a side edge of the spherical triangle.

In another embodiment, the dipyramid dimple patterns may be arranged such that a dimple lies at one or more vertices of the spherical triangle. In this embodiment, the centroid of the dimple is located at the vertex of the spherical triangle and a portion of the dimple is located within the other spherical triangles. That is, the dimple located at the vertex of the spherical triangle may be centered on the vertices of the spherical triangles. The dimple patterns of the present disclosure may include a dimple located at a single vertex of the spherical triangle. In another embodiment, the dimple patterns may include a dimple located at each of two vertices of the spherical triangle. In still another embodiment, the dimple patterns may include a dimple located at each of the three vertices of the spherical triangle.

The dimple patterns arranged in each of the dimple sections, for example, in each of the spherical triangles, are substantially identical to each other. For purposes of the present disclosure, dimple patterns are "substantially identical" if they have substantially the same dimple arrangement (i.e., the relative positions of each of the dimples' centroids are about the same) and substantially the same dimple characteristics (e.g., plan shape, cross-sectional shape, diameter, edge angle). Thus, for each dimple located entirely within a particular dimple section, for example, a particular spherical triangle, there is a corresponding dimple in each of the other dimple sections. For dimples having a centroid located along an edge of the dimple section, there is a corresponding dimple located along the same edge in the other dimple sections. For dimples located at the one or more vertices of the dimple sections, these dimples are shared between the other dimple sections.

The dimple patterns within each dimple section, for example, within each spherical triangle, include dimples having varying dimple diameters. In one embodiment, each dimple pattern has at least two different dimple diameters, including a minimum diameter dimple and a maximum diameter dimple. For example, the triangular and hexagonal dipyramid layouts disclosed herein may include dimple patterns having at least two different dimple diameters. For purposes of the present disclosure, dimples having substantially different diameters include dimples on a finished ball having respective diameters that differ by 0.005 inches or more. In another embodiment, each dimple pattern has at least three different dimple diameters, including a minimum diameter dimple, a maximum diameter dimple, and at least one additional diameter dimple. For instance, the quadrilateral and pentagonal dipyramid layouts disclosed herein may include dimple patterns having at least three different dimple diameters. In another embodiment, each dimple pattern has at least four different dimple diameters, including a minimum diameter dimple, a maximum diameter dimple, and at least two additional diameter dimples. In still another embodiment, each dimple pattern has at least five different dimple diameters, including a minimum diameter dimple, a maximum diameter dimple, and at least three additional diameter dimples. In yet another embodiment, each dimple pattern has at least six different dimple diameters, including a minimum diameter dimple, a maximum diameter dimple, and at least four additional diameter dimples. In still another embodiment, each dimple pattern has at least seven different dimple diameters, including a minimum diameter dimple, a maximum diameter dimple, and at least five additional diameter dimples.

In one embodiment, each dimple has a dimple diameter of about 0.030 inches to about 0.200 inches. In another embodiment, each dimple has a dimple diameter of about 0.050 inches to about 0.180 inches. In still another embodiment, each dimple has a dimple diameter of about 0.070 inches to about 0.160 inches. In yet another embodiment, each dimple has a dimple diameter of about 0.090 inches to about 0.140 inches. In some embodiments, the minimum dimple diameter is less than 0.100 inches. For instance, the minimum dimple diameter may be about 0.030 inches to about 0.100 inches. In another embodiment, the minimum dimple diameter may be about 0.050 inches to about 0.090 inches.

The minimum and maximum differences between any two dimple diameters within a dimple section may vary. In one embodiment, the minimum difference between any two dimple diameters within a dimple section is about 0.030 inches or more. In another embodiment, the minimum difference between any two dimple diameters within a dimple section is about 0.040 inches or more. In other embodiments, the maximum difference between any two dimple diameters within a dimple section is about 0.080 inches or less. In another embodiment, the maximum difference between any two dimple diameters within a dimple section is about 0.065 inches or less. In still another embodiment, the maximum difference between any two dimple diameters within a dimple section is about 0.055 inches or less. In another embodiment, the maximum difference between any two dimple diameters within a dimple section is about 0.045 inches or less. For instance, the difference between any two dimple diameters within each dimple section is about 0.030 inches to about 0.080 inches.

In some embodiments, the dimple pattern includes at least one dimple intersecting a side edge of the dimple section. In this embodiment, at least one dimple having the minimum dimple diameter intersects the side edge of the dimple section. In another embodiment, at least one dimple having the maximum dimple diameter intersects the side edge of the dimple section. In still another embodiment, at least one dimple having neither the minimum nor maximum dimple diameter intersects the side edge of the dimple section. Additionally, in some embodiments, the dimple pattern includes at least one dimple lying at a vertex of the dimple section. In one embodiment, at least one dimple having the maximum dimple diameter is located at a vertex of the dimple section. In another embodiment, at least one dimple having the minimum dimple diameter is located at a vertex of the dimple section. In still another embodiment, at least one dimple having neither the minimum nor maximum dimple diameter is located at a vertex of the dimple section.

In one embodiment, the dipyramid dimple patterns disclosed herein may be symmetric. For example, the dimple patterns within each dimple section may be rotationally symmetric about the central point of each dimple section. That is, the dimple patterns may have three-way rotational symmetry about an axis connecting the center of the golf ball and the central point of the dimple section. In another embodiment, the dimple patterns may have mirror symmetry about a central plane of each dimple section, where the central plane is a plane containing the center of the golf ball, the central point of the corresponding dimple section, and one vertex of the corresponding dimple section. In still other embodiments, the dimple patterns disclosed herein are not rotationally symmetric. For example, the triangular and hexagonal dipyramid dimple patterns may not be rotationally symmetric about the central point of each dimple section.

In one embodiment, the dimples may be arranged within each dimple section such that there are more than three dimple free great circles on the outer surface of the golf ball. For example, the dimples may be arranged within each dimple section such that there are four dimple free great circles on the outer surface of the golf ball. In other embodiments, the dimples may be arranged within each dimple section such that there is one dimple free great circle on the outer surface of the golf ball. In still other embodiments, the dimples may be arranged within each dimple section such that there are no dimple free great circles on the outer surface of the golf ball.

The dimples may be positioned within each dimple section according to any packing method known in the art so long as the dimple sections are substantially identical and meet the symmetry and surface coverage requirements discussed herein. For example, the dimples may be arranged within each dimple section according to the methods described in U.S. Pat. No. 10,183,195, issued on Jan. 22, 2019; U.S. Pat. No. 7,503,856, issued on Mar. 17, 2009; pending U.S. application Ser. No. 16/587,298, filed on Sep. 30, 2019; and pending U.S. application Ser. No. 16/587,321, filed on Sep. 30, 2019, the entire disclosures of which are incorporated herein by reference.

Octahedral Dimple Patterns

In still another embodiment, golf balls of the present invention include dimple patterns that have an octahedral layout. The golf ball dimple patterns are arranged in an octahedral layout such that there are eight identical sections on the golf ball. In one embodiment, each section is in the shape of a spherical triangle. The three circular arcs each represent an edge of the spherical triangle.

The dimples may be located entirely within a dimple section. For example, in one embodiment, the dimples may be arranged within the edges of the spherical triangle such that no dimples intersect an edge of the spherical triangle. In another embodiment, dimples may be shared between two or more dimples sections. In one aspect of this embodiment, for each dimple that is not located entirely within a dimple section, the centroid of the dimple is located along a side edge or at one or more vertices of the spherical triangle. In another aspect of this embodiment, dimples shared between two sections may include dimples that are positioned such that the centroid of the dimple does not lie along a side edge. For purposes of the present disclosure, the "centroid" of the dimple refers to the center of the dimple.

In one embodiment of the present invention, the dimple pattern within each of the eight identical dimple sections may be arranged such that one or more dimples intersect an edge of the spherical triangle. In a particular aspect of this embodiment, the edge intersected by the one or more dimples runs through the centroid of the dimple such that half of the dimple is located within one spherical triangle and the other half is located within another spherical triangle. In another aspect of this embodiment, the edge intersected by one or more dimples does not run through the centroid of the dimple. That is, less than half of the dimple is located within one spherical triangle and more than half of the dimple is located within an adjacent spherical triangle. In one embodiment, the dimple pattern within each of the eight identical dimple sections includes at least three dimples that intersect an edge of the spherical triangle. In another embodiment, the dimple pattern within each of the eight identical dimple sections includes at least six dimples that intersect an edge of the spherical triangle. In another embodiment, the dimple pattern within each of the eight identical dimple sections includes at least twelve dimples that intersect an edge of the spherical triangle. In another embodiment, the dimple pattern within each of the eight identical dimple sections includes at least fifteen dimples that intersect an edge of the spherical triangle.

In another embodiment, the octahedral dimple patterns may be arranged such that a dimple lies at one or more vertices of the spherical triangle. In this embodiment, the centroid of the dimple is located at the vertex of the spherical triangle and a portion of the dimple is located within four of the spherical triangles. That is, the dimple located at the vertex of the spherical triangle may be centered on the vertices of the spherical triangles. The dimple patterns of the present disclosure may include a dimple located at a single vertex of the spherical triangle. In another embodiment, the dimple patterns may include a dimple located at each of two vertices of the spherical triangle. In still another embodiment, the dimple patterns may include a dimple located at each of the three vertices of the spherical triangle.

The dimple patterns arranged in each of the dimple sections, for example, in each of the eight spherical triangles, are substantially identical to each other. For purposes of the present disclosure, dimple patterns are "substantially identical" if they have substantially the same dimple arrangement (i.e., the relative positions of each of the dimples' centroids are about the same) and substantially the same dimple characteristics (e.g., plan shape, cross-sectional shape, diameter, edge angle). Thus, for each dimple located entirely within a particular dimple section, for example, a particular spherical triangle, there is a corresponding dimple in each of the other seven dimple sections. For dimples having a centroid located along an edge of the dimple section, there is a corresponding dimple located along the same edge in the other seven dimple sections. For dimples located at the one or more vertices of the dimple sections, these dimples are shared between the other dimple sections.

The dimple patterns within each dimple section, for example, within each of the eight spherical triangles, include dimples having varying dimple diameters. In one embodiment, each dimple pattern has at least three different dimple diameters, including a minimum diameter dimple, a maximum diameter dimple, and at least one additional diameter dimple. For purposes of the present disclosure, dimples having substantially different diameters include dimples on a finished ball having respective diameters that differ by 0.005 inches or more. In another embodiment, each dimple pattern has at least four different dimple diameters, including a minimum diameter dimple, a maximum diameter dimple, and at least two additional diameter dimples. In still another embodiment, each dimple pattern has at least five different dimple diameters, including a minimum diameter dimple, a maximum diameter dimple, and at least three additional diameter dimples. In yet another embodiment, each dimple pattern has at least six different dimple diameters, including a minimum diameter dimple, a maximum diameter dimple, and at least four additional diameter dimples.

In one embodiment, each dimple has a dimple diameter of about 0.030 inches to about 0.200 inches. In another embodiment, each dimple has a dimple diameter of about 0.050 inches to about 0.180 inches. In still another embodiment, each dimple has a dimple diameter of about 0.070 inches to about 0.160 inches. In yet another embodiment, each dimple has a dimple diameter of about 0.090 inches to about 0.140 inches. In some embodiments, the minimum dimple diameter is less than 0.100 inches. For instance, the minimum dimple diameter may be about 0.030 inches to about 0.100 inches. In another embodiment, the minimum dimple diameter may be about 0.050 inches to about 0.090 inches.

The minimum and maximum differences between any two dimple diameters within a dimple section may vary. In one embodiment, the minimum difference between any two dimple diameters within a dimple section is about 0.030 inches or more. In another embodiment, the minimum difference between any two dimple diameters within a dimple section is about 0.040 inches or more. In other embodiments, the maximum difference between any two dimple diameters within a dimple section is about 0.075 inches or less. In another embodiment, the maximum difference between any two dimple diameters within a dimple section is about 0.055 inches or less. In still another embodiment, the maximum difference between any two dimple diameters within a dimple section is about 0.045 inches or less. For instance, the difference between any two dimple diameters within each dimple section is about 0.030 inches to about 0.075 inches.

In some embodiments, the dimple pattern includes at least one dimple intersecting an edge of the dimple section. In this embodiment, at least one dimple having the minimum dimple diameter intersects the edge of the dimple section. In another embodiment, at least one dimple having the maximum dimple diameter intersects the edge of the dimple section. In still another embodiment, at least one dimple having the minimum dimple diameter and at least one dimple having the maximum dimple diameter intersect the edge of the dimple section. In still another embodiment, at least one dimple having neither the minimum nor maximum dimple diameter intersects the edge of the dimple section. Additionally, in some embodiments, the dimple pattern includes at least one dimple lying at a vertex of the dimple section. In this aspect, at least one dimple having the minimum or maximum dimple diameter is located at a vertex of the dimple section. In another embodiment, at least one dimple having neither the minimum nor maximum dimple diameter is located at a vertex of the dimple section.

In one embodiment, the octahedral dimple patterns disclosed herein may be symmetric. For example, the dimple patterns within each dimple section may be rotationally symmetric about the central point of each dimple section. That is, the dimple patterns may have three-way rotational symmetry about an axis connecting the center of the golf ball and the central point of the dimple section. In another embodiment, the dimple patterns may have mirror symmetry about a central plane of each dimple section, where the central plane is a plane containing the center of the golf ball, the central point of the corresponding dimple section, and one vertex of the corresponding dimple section.

In one embodiment, the dimples may be arranged within each of the eight dimple sections such that there are more than three dimple free great circles on the outer surface of the golf ball. For instance, the dimples may be arranged within each dimple section such that there are four dimple free great circles on the outer surface of the golf ball. In yet another embodiment, the dimples may be arranged within each dimple section such that there are five or more dimple free great circles on the outer surface of the golf ball.

The dimples may be positioned within each of the eight dimple sections according to any packing method known in the art so long as the dimple sections are substantially identical and meet the symmetry and surface coverage requirements discussed herein. For example, the dimples may be arranged within each dimple section according to the methods described in U.S. Pat. No. 10,532,252, issued on Jan. 14, 2020, the entire disclosure of which is incorporated herein by reference.

Icosahedral Dimple Patterns

In yet another embodiment, dimple patterns utilized with golf balls of the present disclosure are arranged in an icosahedral layout. The golf ball dimple patterns are arranged in an icosahedral layout such that there are 20 identical sections on the golf ball. In one embodiment, each section is in the shape of a spherical triangle. The three circular arcs each represent an edge of the spherical triangle.

The dimples may be located entirely within a dimple section. For example, in one embodiment, the dimples may be arranged within the edges of the spherical triangle such that no dimples intersect an edge of the spherical triangle. In another embodiment, dimples may be shared between two or more dimples sections. In one aspect of this embodiment, for each dimple that is not located entirely within a dimple section, the centroid of the dimple is located along a side edge or at one or more vertices of the spherical triangle. In another aspect of this embodiment, dimples shared between two sections may include dimples that are positioned such that the centroid of the dimple does not lie along a side edge. For purposes of the present disclosure, the "centroid" of the dimple refers to the center of the dimple.

In one embodiment of the present invention, the dimple pattern within each of the 20 identical dimple sections may be arranged such that one or more dimples intersect an edge of the spherical triangle. In a particular aspect of this embodiment, the edge intersected by the one or more dimples runs through the centroid of the dimple such that half of the dimple is located within one spherical triangle and the other half is located within another spherical triangle. In another aspect of this embodiment, the edge intersected by one or more dimples does not run through the centroid of the dimple. That is, less than half of the dimple is located within one spherical triangle and more than half of the dimple is located within an adjacent spherical triangle. In one embodiment, the dimple pattern within each of the 20 identical dimple sections includes at least three dimples that intersect an edge of the spherical triangle. In another embodiment, the dimple pattern within each of the 20 identical dimple sections includes at least six dimples that intersect an edge of the spherical triangle. In another embodiment, the dimple pattern within each of the 20 identical dimple sections includes at least twelve dimples that intersect an edge of the spherical triangle. In another embodiment, the dimple pattern within each of the 20 identical dimple sections includes at least fifteen dimples that intersect an edge of the spherical triangle.

In another embodiment, the icosahedral dimple patterns may be arranged such that a dimple lies at one or more vertices of the spherical triangle. In this embodiment, the centroid of the dimple is located at the vertex of the spherical triangle and a portion of the dimple is located within five of the spherical triangles. That is, the dimple located at the vertex of the spherical triangle may be centered on the vertices of the spherical triangles. The dimple patterns of the present disclosure may include a dimple located at a single vertex of the spherical triangle. In another embodiment, the dimple patterns may include a dimple located at each of two vertices of the spherical triangle. In still another embodiment, the dimple patterns may include a dimple located at each of the three vertices of the spherical triangle.

The dimple patterns arranged in each of the dimple sections, for example, in each of the 20 spherical triangles, are substantially identical to each other. For purposes of the present disclosure, dimple patterns are "substantially identical" if they have substantially the same dimple arrangement (i.e., the relative positions of each of the dimples' centroids are about the same) and substantially the same dimple characteristics (e.g., plan shape, cross-sectional shape, diameter, edge angle). Thus, for each dimple located entirely within a particular dimple section, for example, a particular spherical triangle, there is a corresponding dimple in each of the other 19 dimple sections. For dimples having a centroid located along an edge of the dimple section, there is a corresponding dimple located along the same edge in the other 19 dimple sections. For dimples located at the one or more vertices of the dimple sections, these dimples are shared between the other dimple sections.

The dimple patterns within each dimple section, for example, within each of the 20 spherical triangles, include dimples having varying dimple diameters. In one embodiment, each dimple pattern has at least three different dimple diameters, including a minimum diameter dimple, a maximum diameter dimple, and at least one additional diameter dimple. For purposes of the present disclosure, dimples having substantially different diameters include dimples on a finished ball having respective diameters that differ by 0.005 inches or more. In another embodiment, each dimple pattern has at least four different dimple diameters, including a minimum diameter dimple, a maximum diameter dimple, and at least two additional diameter dimples. In still another embodiment, each dimple pattern has at least five different dimple diameters, including a minimum diameter dimple, a maximum diameter dimple, and at least three additional diameter dimples. In yet another embodiment, each dimple pattern has at least six different dimple diameters, including a minimum diameter dimple, a maximum diameter dimple, and at least four additional diameter dimples.

In one embodiment, each dimple has a dimple diameter of about 0.030 inches to about 0.200 inches. In another embodiment, each dimple has a dimple diameter of about 0.050 inches to about 0.180 inches. In still another embodiment, each dimple has a dimple diameter of about 0.070 inches to about 0.160 inches. In yet another embodiment, each dimple has a dimple diameter of about 0.090 inches to about 0.140 inches. In some embodiments, the minimum dimple diameter is less than 0.100 inches. For instance, the minimum dimple diameter may be about 0.030 inches to about 0.100 inches. In another embodiment, the minimum dimple diameter may be about 0.050 inches to about 0.090 inches.

The minimum and maximum differences between any two dimple diameters within a dimple section may vary. In one embodiment, the minimum difference between any two dimple diameters within a dimple section is about 0.030 inches or more. In another embodiment, the minimum difference between any two dimple diameters within a dimple section is about 0.040 inches or more. In other embodiments, the maximum difference between any two dimple diameters within a dimple section is about 0.080 inches or less. In another embodiment, the maximum difference between any two dimple diameters within a dimple section is about 0.065 inches or less. In still another embodiment, the maximum difference between any two dimple diameters within a dimple section is about 0.055 inches or less. In another embodiment, the maximum difference between any two dimple diameters within a dimple section is about 0.045 inches or less. For instance, the difference between any two dimple diameters within each dimple section is about 0.030 inches to about 0.080 inches.

In some embodiments, the dimple pattern includes at least one dimple intersecting an edge of the dimple section. In this embodiment, at least one dimple having the minimum dimple diameter intersects the edge of the dimple section. In another embodiment, at least one dimple having the maximum dimple diameter intersects the edge of the dimple section. In still another embodiment, at least one dimple having neither the minimum nor maximum dimple diameter intersects the edge of the dimple section. Additionally, in some embodiments, the dimple pattern includes at least one dimple lying at a vertex of the dimple section. In one embodiment, at least one dimple having the maximum dimple diameter is located at a vertex of the dimple section. In another embodiment, at least one dimple having the minimum dimple diameter is located at a vertex of the dimple section.

In one embodiment, the icosahedral dimple patterns disclosed herein may be symmetric. For example, the dimple patterns within each dimple section may be rotationally symmetric about the central point of each dimple section. That is, the dimple patterns may have three-way rotational symmetry about an axis connecting the center of the golf ball and the central point of the dimple section. In another embodiment, the dimple patterns may have mirror symmetry about a central plane of each dimple section, where the central plane is a plane containing the center of the golf ball, the central point of the corresponding dimple section, and one vertex of the corresponding dimple section.

In one embodiment, the dimples may be arranged within each of the 20 dimple sections such that there are more than four dimple free great circles on the outer surface of the golf ball. For example, the dimples may be arranged within each dimple section such that there are five dimple free great circles on the outer surface of the golf ball. In another embodiment, the dimples may be arranged within each dimple section such that there are six dimple free great circles on the outer surface of the golf ball. In other embodiments, the dimples may be arranged within each dimple section such that there are no dimple free great circles on the outer surface of the golf ball.

The dimples may be positioned within each of the 20 dimple sections according to any packing method known in the art so long as the dimple sections are substantially identical and meet the symmetry and surface coverage requirements discussed herein. For example, the dimples may be arranged within each dimple section according to the methods described in U.S. Pat. No. 10,668,327, issued on Jun. 2, 2020, the entire disclosure of which is incorporated herein by reference.

Dimple Dimensions

The dimples contemplated for use in the dimple patterns described above have a circular plan shape. However, the dimples may also have a variety of other plan shapes, such as square, triangle, rectangle, oval, or plan shapes defined by low frequency periodic functions or high frequency periodic functions. The diameter of a dimple having a non-circular plan shape is defined by its equivalent diameter, $d_e$, which may be calculated according to equation (II):

$$d_e = 2\sqrt{\frac{A}{\pi}}, \quad \text{(II)}$$

where $d_e$ is the equivalent dimple diameter and A is the plan shape area of the dimple. By the term, "plan shape area," it is meant the area based on a planar view of the dimple plan shape, such that the viewing plane is normal to an axis connecting the center of the golf ball to the point of the calculated surface depth. In one embodiment, the equivalent diameters of dimples having non-circular plan shapes are the same as the ranges of dimple diameters discussed above for the circular plan shaped dimples.

Diameter measurements are determined on finished golf balls according to FIG. 1. Generally, it may be difficult to measure a dimple's diameter due to the indistinct nature of the boundary dividing the dimple from the ball's undisturbed land surface. Due to the effect of paint and/or the dimple design itself, the junction between the land surface and dimple may not be a sharp corner and is therefore indistinct. This can make the measurement of a dimple's diameter somewhat ambiguous.

To resolve this problem, dimple diameter on a finished golf ball is measured according to the method shown in FIG. 1. FIG. 1 shows a dimple half-profile 34, extending from a dimple centerline 31 to the land surface outside of the dimple 33. A ball phantom surface 32 is constructed above the dimple as a continuation of the land surface 33. A first tangent line T1 is then constructed at a point on the dimple sidewall that is spaced 0.003 inches radially inward from the phantom surface 32. The first tangent line T1 intersects the phantom surface 32 at a point P1, which defines a nominal dimple edge position. A second tangent line T2 is then constructed, tangent to the phantom surface 32 at P1. The edge angle is the angle between the first tangent line T1 and the second tangent line T2. The dimple diameter is the distance between P1 and its equivalent point diametrically opposite along the dimple perimeter. Alternatively, it is twice the distance between P1 and the dimple centerline 31, measured in a direction perpendicular to the dimple centerline 31. The dimple depth is the distance measured along a ball radius from the phantom surface 32 of the ball to the deepest point on the dimple. The chord plane runs through the point P1 and is normal to the dimple centerline 31. The chord depth is the distance from the chord plane to the deepest part of the dimple. The cap height is the distance from the chord plane to the phantom surface 32 along the dimple centerline 31. The dimple volume is the space enclosed between the phantom surface 32 and the dimple surface 34 (extended along the first tangent line T1 until it intersects the phantom surface 32).

Figure 2:
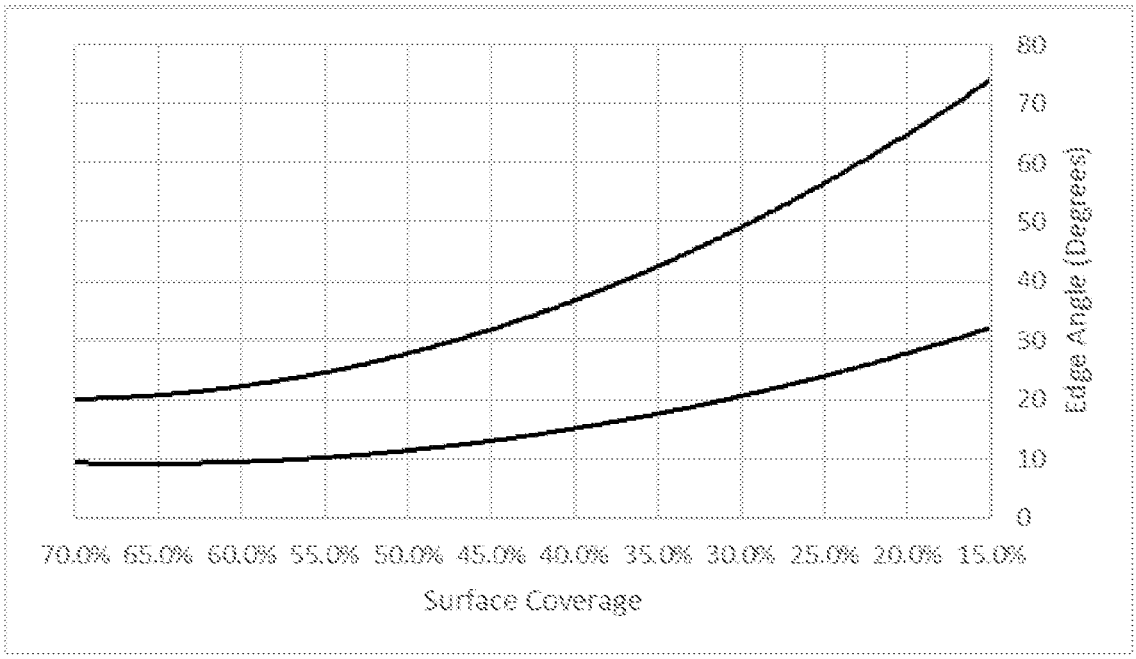
FIG. 2 is a graphical representation of the relationship between edge angle and surface coverage according to one embodiment of the present disclosure.

The dimple patterns described herein may have varying edge angles depending on the desired surface coverage. Optimization of the edge angles using the equations provided herein can help reduce the flight of the ball while maintaining ideal trajectories. For spherical dimples, the edge angle is defined as the angle between the first tangent line T1 and the second tangent line T2, as shown in FIG. 1. In one embodiment, the average edge angle ($\theta_\mu$) of all the dimple edge angles on the golf ball is related to the surface coverage based on the range displayed in equation (III) below:

$$88.8(SC)^2 - 116.9(SC) + 47.7 \le \theta_\mu \le 170.0(SC)^2 - 242.5(SC) + 106.6, \quad \text{(III)}$$

where SC is the surface coverage and the format for SC is the decimal form of percentage (for example, 50 percent coverage is 0.50). FIG. 2 is a graphical representation of the relationship between edge angle and surface coverage of spherical dimples according to an embodiment of the present disclosure. In one embodiment, the dimples may have any edge angle falling within the range of values shown in FIG. 2. For instance, with a desired surface coverage of about 70 percent, the average edge angle of all the dimple edge angles on the golf ball may range from about 9.38 degrees to about 20.15 degrees. In another embodiment, with a desired surface coverage of about 50 percent, the average edge angle of all the dimple edge angles on the golf ball may range from about 11.45 degrees to about 27.85 degrees. In still another embodiment, with a desired surface coverage of about 30 percent, the average edge angle of all the dimple edge angles on the golf ball may range from about 20.62 degrees to about 49.15 degrees. In yet another embodiment, with a desired surface coverage of about 15 percent, the average edge angle of all the dimple edge angles on the golf ball may range from about 32.16 degrees to about 74.05 degrees. Accordingly, in some embodiments, as the surface coverage of the dimple patterns described herein decreases, the average edge angles may increase.

In one embodiment, the edge angle of all the dimples within a dimple section is substantially the same. For purposes of the present disclosure, edge angles on a finished golf ball are substantially identical if they differ by less than about 0.25 degrees. In another embodiment, the dimples within a dimple section may have two different edge angles. That is, the dimples within a dimple section may have two different edge angles that differ by more than about 0.25 degrees. In still another embodiment, the dimples within a dimple section may have three different edge angles, where each edge angle differs from the others by more than about 0.25 degrees.

In the embodiments where the dimples may have varying edge angles, the maximum difference in edge angle between any two dimples within a dimple section may be about 1 degree to about 4 degrees. In one embodiment, the maximum difference in edge angle between any two dimples within a dimple section may be about 1 degree to about 3 degrees. For example, in a preferred embodiment, the maximum difference in edge angle between any two dimples within a dimple section is about 1 degree.

The spherical dimples contemplated by the present disclosure may also have a dimple depth, chord depth, and cap height, as defined and shown in FIG. 1. In one embodiment, when golf balls of the present disclosure have a desired surface coverage of about 70 percent, the dimple depths may range from about 0.0049 inches to about 0.0146 inches. In another embodiment, when golf balls of the present disclosure have a desired surface coverage of about 50 percent, the dimple depths may range from about 0.0049 inches to about 0.0175 inches. In still another embodiment, when golf balls of the present disclosure have a desired surface coverage of about 30 percent, the dimple depths may range from about 0.0063 inches to about 0.0259 inches. In yet another embodiment, when golf balls of the present disclosure have a desired surface coverage of about 15 percent, the dimple depths may range from about 0.0072 inches to about 0.0369 inches.

Figure 3:
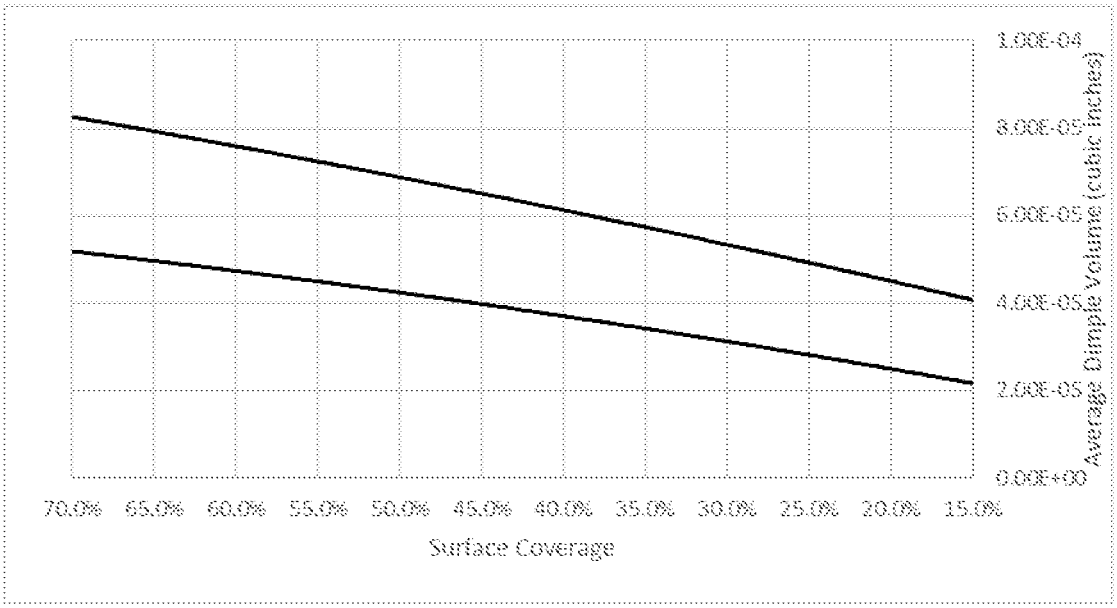
FIG. 3 is a graphical representation of the relationship between average dimple volume and surface coverage according to another embodiment of the present disclosure.

While the dimples have been exemplified herein as having a spherical profile, the dimples may have a variety of other profile shapes. For non-spherical dimples, the average dimple volume is related to the surface coverage. The "dimple volume" refers to the total volume encompassed by the dimple shape and the phantom surface of the golf ball. In one embodiment, the average dimple volume ($V_\mu$) of all the dimple volumes is related to the surface coverage based on the range displayed in equation (IV) below:

$$-2.2\times10^{-5}(SC)^2+7.4\times10^{-5}(SC)+1.1\times10^{-5}\leq V_\mu\leq-2.0\times10^{-5}(SC)^2+9.3\times10^{-5}(SC)+2.7\times10^{-5}, \quad \text{(IV)}$$

where SC is the surface coverage and the format for SC is the decimal form of percentage, for example, 50 percent is 0.50. FIG. 3 is a graphical representation of the relationship between average dimple volume and surface coverage of non-spherical dimples according to an embodiment of the present disclosure. In one embodiment, the dimples may have any average dimple volume falling within the range of values shown in FIG. 3. For example, with a desired surface coverage of about 70 percent, the average dimple volume of all the dimple volumes is about $5.20\times10^{-5}$ cubic inches to about $8.23\times10^{-5}$ cubic inches. In another embodiment, with a desired surface coverage of about 50 percent, the average dimple volume of all the dimple volumes is about $4.25\times10^{-5}$ cubic inches to about $6.85\times10^{-5}$ cubic inches. In still another embodiment, with a desired surface coverage of about 30 percent, the average dimple volume of all the dimple volumes is about $3.12\times10^{-5}$ cubic inches to about $5.31\times10^{-5}$ cubic inches. In yet another embodiment, with a desired surface coverage of about 15 percent, the average dimple volume of all the dimple volumes is about $2.16\times10^{-5}$ cubic inches to about $4.05\times10^{-5}$ cubic inches. Accordingly, in some embodiments, as the surface coverage of the dimple patterns described herein decreases, the average dimple volumes may also decrease.

Core Formulations

In one embodiment, golf balls made in accordance with the present disclosure have at least one core layer formed from a rubber formulation of polybutadiene rubber, butyl rubber, or a blend thereof. The at least one core layer may be the center of the golf ball, a layer surrounding the center (for instance, an intermediate layer), or a combination thereof.

Polybutadiene is a homopolymer of 1,3-butadiene. The double bonds in the 1,3-butadiene monomer are attacked by catalysts to grow the polymer chain and form a polybutadiene polymer having a desired molecular weight. Any suitable catalyst may be used to synthesize the polybutadiene rubber depending upon the desired properties. In one embodiment, a transition metal complex (for example, neodymium, nickel, or cobalt) or an alkyl metal such as alkyl lithium is used as a catalyst. Other catalysts include, but are not limited to, aluminum, boron, lithium, titanium, and combinations thereof. The catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber can have various combinations of cis- and trans-bond structures. In one embodiment, the polybutadiene rubber has a 1,4 cis-bond content of at least 40%. In another embodiment, the polybutadiene rubber has a 1,4 cis-bond content of greater than 80%. In still another embodiment, the polybutadiene rubber has a 1,4 cis-bond content of greater than 90%. In general, polybutadiene rubbers having a high 1,4 cis-bond content have high tensile strength.

The polybutadiene rubber may have a relatively high or low Mooney viscosity. Generally, polybutadiene rubbers of higher molecular weight and higher Mooney viscosity have better resiliency than polybutadiene rubbers of lower molecular weight and lower Mooney viscosity. However, as the Mooney viscosity increases, the milling and processing of the polybutadiene rubber generally becomes more difficult. Blends of high and low Mooney viscosity polybutadiene rubbers may be prepared as is described in Voorheis et al., U.S. Pat. Nos. 6,982,301 and 6,774,187, the disclosures of which are hereby incorporated by reference, and used in accordance with this invention. In general, the lower limit of Mooney viscosity may be 30 or 35 or 40 or 45 or 50 or 55 or 60 or 70 or 75 and the upper limit may be 80 or 85 or 90 or 95 or 100 or 105 or 110 or 115 or 120 or 125 or 130.

Examples of commercially available polybutadiene rubbers that can be used in accordance with this invention, include, but are not limited to, BR 01 and BR 1220, available from BST Elastomers of Bangkok, Thailand; SE BR 1220LA and SE BR1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 IVIES, CB 60, CB Nd 60, CB 55 NF, CB 70 B, CB KA 8967, and CB 1221, available from Lanxess Corp. of Pittsburgh. Pa.; BR1208, available from LG Chemical of Seoul, South Korea; UBEPOL BR130B, BR150, BR150B, BR150L, BR230, BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; AFDENE 50 and NEODENE BR40, BR45, BR50 and BR60, available from Karbochem (PTY) Ltd. of Bruma, South Africa; KBR 01, NdBr 40, NdBR-45, NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio; and PBR-Nd Group II and Group III, available from Nizhnekamskneftekhim, Inc. of Nizhnekamsk, Tartarstan Republic.

In another embodiment, golf balls made in accordance with the present disclosure have at least one core layer formed from butyl rubber. Butyl rubber is an elastomeric copolymer of isobutylene and isoprene. Butyl rubber is an amorphous, non-polar polymer with good oxidative and thermal stability, good permanent flexibility and high moisture and gas resistance. Generally, butyl rubber includes copolymers of about 70% to 99.5% by weight of an isoolefin, which has about 4 to 7 carbon atoms, for example, isobutylene, and about 0.5% to 30% by weight of a conjugated multiolefin, which has about 4 to 14 carbon atoms, for example, isoprene. The resulting copolymer contains about 85% to about 99.8% by weight of combined isoolefin and 0.2% to 15% of combined multiolefin. A commercially available butyl rubber includes Bayer Butyl 301 manufactured by Bayer AG.

In some embodiments, the polybutadiene rubber and the butyl rubber are blended together to form at least one core layer. In this embodiment, the core layer may include a blend of polybutadiene rubber and butyl rubber in a ratio of about 10:90 to about 90:10. In another embodiment, the core layer may include a blend of polybutadiene rubber and butyl rubber in a ratio of about 30:70 to about 70:30. In still another embodiment, the core layer may include a blend of polybutadiene rubber and butyl rubber in a ratio of about 40:60 to about 60:40.

In other embodiments, the polybutadiene rubber and/or butyl rubber may be blended with other elastomers including, but not limited to, polyisoprene, ethylene propylene rubber ("EPR"), styrene-butadiene rubber, styrenic block copolymer rubbers (such as "SI", "SIS", "SB", "SBS", "SIBS", and the like, where "S" is styrene, "I" is isobutylene, and "B" is butadiene), polyalkenamers such as, for example, polyoctenamer, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof.

In one embodiment, the amount of polybutadiene rubber present in the core layer is related to the surface coverage of dimples on the outer cover. For example, the amount of polybutadiene rubber present in the core layer and the surface coverage of dimples have the relationship shown in equation (V) below:

$$\frac{BR}{1-SC} \leq 2.0 \quad \text{(V)}$$

where BR represents the weight percent of polybutadiene rubber, in decimal form, based on the total weight of rubber in the core layer composition, and $0 \leq BR \leq 1$; and SC represents the surface coverage in the decimal form of percentage, and $0 < SC < 1$. According to formula (V), a golf ball made in accordance with the present disclosure and having a surface coverage of about 70 percent (SC=0.70) may include at least one core layer having a weight percentage of polybutadiene rubber of about 60 percent or less ($BR \leq 0.60$). In another embodiment, a golf ball made in accordance with the present disclosure and having a surface coverage of about 65 percent (SC=0.65) may include at least one core layer having a weight percentage of polybutadiene rubber of about 70 percent or less ($BR \leq 0.70$). In another embodiment, a golf ball made in accordance with the present disclosure and having a surface coverage of about 60 percent (SC=0.60) may include at least one core layer having a weight percentage of polybutadiene rubber of about 80 percent or less ($BR \leq 0.80$). In still another embodiment, a golf ball made in accordance with the present disclosure and having a surface coverage of about 50 percent (SC=0.50) may include at least one core layer having a weight percentage of polybutadiene rubber of about 100 percent or less ($BR \leq 1$).

In another embodiment, the amount of polybutadiene rubber present in the core layer and the surface coverage of dimples have the relationship shown in formula (VI) below:

$$\frac{BR}{1-SC} \leq 1.75 \quad \text{(VI)}$$

where BR represents the weight percent of polybutadiene rubber, in decimal form, based on the total weight of rubber in the core layer composition, and $0 \leq BR \leq 1$; and SC represents the surface coverage in the decimal form of percentage, and $0 < SC < 1$. For example, a golf ball made in accordance with the present disclosure and having a surface coverage of about 70 percent (SC=0.70) may include at least one core layer having a weight percentage of polybutadiene rubber of about 52.5 percent or less ($BR \leq 0.525$). In another embodiment, a golf ball made in accordance with the present disclosure and having a surface coverage of about 65 percent (SC=0.65) may include at least one core layer having a weight percentage of polybutadiene rubber of about 61.3 percent or less ($BR \leq 0.613$). In another embodiment, a golf ball made in accordance with the present disclosure and having a surface coverage of about 60 percent (SC=0.60) may include at least one core layer having a weight percentage of polybutadiene rubber of about 70 percent or less ($BR \leq 0.70$). In still another embodiment, a golf ball made in accordance with the present disclosure and having a surface coverage of about 50 percent (SC=0.50) may include at least one core layer having a weight percentage of polybutadiene rubber of about 87.5 percent or less ($BR \leq 0.875$).

In still another embodiment, the amount of polybutadiene rubber present in the core layer and the surface coverage of dimples have the relationship shown in formula (VII) below:

$$\frac{BR}{1-SC} \leq 1.50 \quad \text{(VII)}$$

where BR represents the weight percent of polybutadiene rubber, in decimal form, based on the total weight of rubber in the core layer composition, and $0 \leq BR \leq 1$; and SC represents the surface coverage in the decimal form of percentage, and $0 < SC < 1$. For example, a golf ball made in accordance with the present disclosure and having a surface coverage of about 70 percent (SC=0.70) may include at least one core layer having a weight percentage of polybutadiene rubber of about 45 percent or less ($BR \leq 0.45$). In another embodiment, a golf ball made in accordance with the present disclosure and having a surface coverage of about 65 percent (SC=0.65) may include at least one core layer having a weight percentage of polybutadiene rubber of about 52.5 percent or less ($BR \leq 0.525$). In another embodiment, a golf ball made in accordance with the present disclosure and having a surface coverage of about 60 percent (SC=0.60) may include at least one core layer having a weight percentage of polybutadiene rubber of about 60 percent or less ($BR \leq 0.60$). In still another embodiment, a golf ball made in accordance with the present disclosure and having a surface coverage of about 50 percent (SC=0.50) may include at least one core layer having a weight percentage of polybutadiene rubber of about 75 percent or less ($BR \leq 0.75$). In yet another embodiment, a golf ball having a surface coverage of about 40 percent (SC=0.40) may include at least one core layer having a weight percentage of polybutadiene rubber of about 90 percent or less (BR≤0.90).

In yet another embodiment, the relationship between the amount of polybutadiene rubber in the core layer and the surface coverage of dimples may include a size modifier and a weight modifier to account for the size and weight of the finished golf ball. For example, the relationship between the weight percentage of polybutadiene rubber in the core and the surface coverage of dimples, including a size modifier and a weight modifier, is shown in formula (VIII) below:

$$\left(\frac{w}{1.62}\right)^3\left(\frac{1.68}{d}\right)^8\left(\frac{BR}{1-SC}\right) \leq 2.0, \text{ (or 1.75 or 1.50)} \quad \text{(VIII)}$$

where BR represents the weight percent of polybutadiene rubber, in decimal form, based on the total weight of rubber in the core layer composition, and 0≤BR≤1; SC represents the surface coverage in the decimal form of percentage, and 0<SC<1; d is the diameter of the golf ball in inches; and w is the weight of the finished golf ball in ounces. According to the Rules of Golf as approved by the USGA, a golf ball may not have a weight in excess of 1.620 ounces (45.93 g) or a diameter of less than 1.680 inches (42.67 mm). However, the USGA rules do not set a minimum weight or a maximum diameter for the ball. In some embodiments, a golf ball having a decreased weight and/or an increased diameter may be made to decrease the overall distance a ball travels at a given swing speed while maintaining a high-performance trajectory during flight. Accordingly, the diameter of golf balls prepared according to the present disclosure may range from about 1.680 inches to about 1.800 inches. In another embodiment, the diameter of the golf balls may range from about 1.688 inches to about 1.800 inches. In still another embodiment, the diameter of the golf balls may range from about 1.690 inches to about 1.740 inches. In yet another embodiment, the diameter of the golf balls may range from 1.695 inches to about 1.725 inches. The weight of the golf balls prepared according to the present disclosure may range from about 1.39 ounces to about 1.62 ounces. For example, the weight of the golf balls may range from about 1.45 ounces to about 1.58 ounces.

Aerodynamic Characteristics

As described above, the golf balls of the present disclosure combine a core formulation having a low percentage of polybutadiene or butyl rubber with a less aerodynamic dimple pattern (for example, a low surface coverage dimple pattern) to achieve a reduction in overall distance when compared to a conventional golf ball. This combination of low surface coverage and low polybutadiene or butyl rubber usage helps to reduce the flight of the ball while also providing improved aerodynamic consistency and maintaining the appearance of a high-performance trajectory.

In some embodiments, the golf balls described herein have reduced speeds, which result in reduced flight. The speed of golf balls made in accordance with the present disclosure is related to the surface coverage of dimples on the outer cover. For example, the initial velocity of a finished golf ball made in accordance with the present disclosure may be related to the surface coverage according to formula (IX) shown below:

$$\frac{IV}{1-SC} \leq 700 \quad \text{(IX)}$$

where IV represents the initial velocity of the finished golf ball in ft/sec and SC is the surface coverage in the decimal form of percentage, and 0<SC<1. For instance, a golf ball made in accordance with the present disclosure and having a surface coverage of about 70 percent (SC=0.70) may have an initial velocity of about 210 ft/sec or less (IV≤210). In another embodiment, a golf ball made in accordance with the present disclosure and having a surface coverage of about 65 percent (SC=0.65) may have an initial velocity of about 245 ft/sec or less (IV≤245). In another embodiment, a golf ball made in accordance with the present disclosure and having a surface coverage of about 60 percent (SC=0.60) may have an initial velocity of about 280 ft/sec or less (IV≤280). In still another embodiment, a golf ball made in accordance with the present disclosure and having a surface coverage of about 50 percent (SC=0.50) may have an initial velocity of about 350 ft/sec or less (IV≤350). In yet another embodiment, a golf ball having a surface coverage of about 40 percent (SC=0.40) may have an initial velocity of about 420 ft/sec or less (IV≤420).

In another embodiment, the initial velocity of a finished golf ball made in accordance with the present disclosure may be related to the surface coverage according to formula (X) shown below:

$$\frac{IV}{1-SC} \leq 600 \quad \text{(X)}$$

where IV represents the initial velocity of the finished golf ball in ft/sec and SC is the surface coverage in the decimal form of percentage, and 0<SC<1. In one embodiment, a golf ball made in accordance with the present disclosure and having a surface coverage of about 70 percent (SC=0.70) may have an initial velocity of about 180 ft/sec or less (IV≤180). In another embodiment, a golf ball made in accordance with the present disclosure and having a surface coverage of about 65 percent (SC=0.65) may have an initial velocity of about 210 ft/sec or less (IV≤210). In another embodiment, a golf ball made in accordance with the present disclosure and having a surface coverage of about 60 percent (SC=0.60) may have an initial velocity of about 240 ft/sec or less (IV≤240). In still another embodiment, a golf ball made in accordance with the present disclosure and having a surface coverage of about 50 percent (SC=0.50) may have an initial velocity of about 300 ft/sec or less (IV≤300). In yet another embodiment, a golf ball having a surface coverage of about 40 percent (SC=0.40) may have an initial velocity of about 360 ft/sec or less (IV≤360).

In still another embodiment, the initial velocity of a finished golf ball made in accordance with the present disclosure may be related to the surface coverage according to formula (XI) shown below:

$$\frac{IV}{1-SC} \leq 500 \quad \text{(XI)}$$

where IV represents the initial velocity of the finished golf ball in ft/sec and SC is the surface coverage in the decimal form of percentage, and 0<SC<1. In one embodiment, a golf ball made in accordance with the present disclosure and having a surface coverage of about 70 percent (SC=0.70) may have an initial velocity of about 150 ft/sec or less (IV≤150). In another embodiment, a golf ball made in accordance with the present disclosure and having a surface coverage of about 65 percent (SC=0.65) may have an initial velocity of about 175 ft/sec or less (IV≤175). In another embodiment, a golf ball made in accordance with the present disclosure and having a surface coverage of about 60 percent (SC=0.60) may have an initial velocity of about 200 ft/sec or less (IV≤200). In still another embodiment, a golf ball made in accordance with the present disclosure and having a surface coverage of about 50 percent (SC=0.50) may have an initial velocity of about 250 ft/sec or less (IV≤250). In yet another embodiment, a golf ball having a surface coverage of about 40 percent (SC=0.40) may have an initial velocity of about 300 ft/sec or less (IV≤300).

In yet another embodiment, the relationship between the initial velocity of a finished golf ball and the surface coverage of dimples may include a size modifier and a weight modifier to account for the size and weight of the finished golf ball. For instance, the relationship between the initial velocity of a finished golf ball made in accordance with the present disclosure and the surface coverage, including the size modifier and the weight modifier, is shown in formula (XII) below:

$$\left(\frac{w}{1.62}\right)^3\left(\frac{1.68}{d}\right)^8\left(\frac{IV}{1-SC}\right) \leq 700, \text{ (or 600 or 500)} \quad \text{(XII)}$$

where IV represents the initial velocity of the finished golf ball in ft/sec, SC represents the surface coverage in the decimal form of percentage and 0<SC<1, d is the diameter of the golf ball in inches, and w is the weight of the finished golf ball in ounces. The diameter and the weight of the finished golf ball may vary according to the ranges discussed above with respect to formula (VIII).

In some embodiments, the coefficient of restitution (COR) of golf balls made in accordance with the present disclosure is also related to the surface coverage of dimples on the outer cover. A golf ball's COR is the ratio of the relative velocity of the ball after direct impact to that before impact. One way to measure the COR is to propel a ball at a given speed against a hard massive surface and measure its incoming velocity and outgoing velocity. The COR is defined as the ratio of the outgoing velocity to incoming velocity of a rebounding ball and is expressed as a decimal. The COR can vary from zero to one, with one being equivalent to an elastic collision and zero being equivalent to an inelastic collision. The COR measurements discussed herein are measured at 125 ft/sec incoming ball velocity In one embodiment, the COR of a finished golf ball made in accordance with the present disclosure may be related to the surface coverage according to formula (XIII) shown below:

$$\frac{COR}{1-SC} \leq 2.0 \quad \text{(XIII)}$$

where COR represents the coefficient of restitution and 0<COR<1, and SC represents the surface coverage in the decimal form of percentage and 0<SC<1. In this embodiment, a golf ball made in accordance with the present disclosure and having a surface coverage of about 70 percent (SC=0.70) may have a COR of about 0.600 or less (COR≤0.600). In another embodiment, a golf ball made in accordance with the present disclosure and having a surface coverage of about 65 percent (SC=0.65) may have a COR of about 0.700 or less (COR≤0.700). In another embodiment, a golf ball made in accordance with the present disclosure and having a surface coverage of about 60 percent (SC=0.60) may have a COR of about 0.800 or less (COR≤0.800). In still another embodiment, a golf ball made in accordance with the present disclosure and having a surface coverage of about 55 percent (SC=0.55) may have a COR of about 0.900 or less (COR≤0.900).

In another embodiment, the COR of a finished golf ball made in accordance with the present disclosure may be related to the surface coverage according to formula (XIV) shown below:

$$\frac{COR}{1-SC} \leq 1.75 \quad \text{(XIV)}$$

where COR represents the coefficient of restitution and 0<COR<1, and SC represents the surface coverage in the decimal form of percentage and 0<SC<1. In this embodiment, a golf ball made in accordance with the present disclosure and having a surface coverage of about 70 percent (SC=0.70) may have a COR of about 0.525 or less (COR≤0.525). In another embodiment, a golf ball made in accordance with the present disclosure and having a surface coverage of about 65 percent (SC=0.65) may have a COR of about 0.613 or less (COR≤0.613). In another embodiment, a golf ball made in accordance with the present disclosure and having a surface coverage of about 60 percent (SC=0.60) may have a COR of about 0.700 or less (COR≤0.700). In still another embodiment, a golf ball made in accordance with the present disclosure and having a surface coverage of about 55 percent (SC=0.55) may have a COR of about 0.788 or less (COR≤0.788). In yet another embodiment, a golf ball made in accordance with the present disclosure and having a surface coverage of about 50 percent (SC=0.50) may have a COR of about 0.875 or less (COR≤0.875).

In still another embodiment, the COR of a finished golf ball made in accordance with the present disclosure may be related to the surface coverage according to formula (XV) shown below:

$$\frac{COR}{1-SC} \leq 1.50 \quad \text{(XV)}$$

where COR represents the coefficient of restitution and 0<COR<1, and SC represents the surface coverage in the decimal form of percentage and 0<SC<1. In this embodiment, a golf ball made in accordance with the present disclosure and having a surface coverage of about 70 percent (SC=0.70) may have a COR of about 0.450 or less (COR≤0.450). In another embodiment, a golf ball made in accordance with the present disclosure and having a surface coverage of about 65 percent (SC=0.65) may have a COR of about 0.525 or less (COR≤0.525). In another embodiment, a golf ball made in accordance with the present disclosure and having a surface coverage of about 60 percent (SC=0.60) may have a COR of about 0.600 or less (COR≤0.600). In still another embodiment, a golf ball made in accordance with the present disclosure and having a surface coverage of about 55 percent (SC=0.55) may have a COR of about 0.675 or less (COR≤0.675). In yet another embodiment, a golf ball made in accordance with the present disclosure and having a surface coverage of about 50 percent (SC=0.50) may have a COR of about 0.750 or less (COR≤0.750).

In yet another embodiment, the relationship between the COR of a finished golf ball and the surface coverage of dimples may include a size modifier and a weight modifier to account for the size and weight of the finished golf ball. For instance, the relationship between the COR of a finished golf ball made in accordance with the present disclosure and the surface coverage, including the size modifier and the weight modifier, is shown in formula (XVI) below:

$$\left(\frac{w}{1.62}\right)^3\left(\frac{1.68}{d}\right)^8\left(\frac{COR}{1-SC}\right) \leq 2.0, \text{ (or 1.75 or 1.50)} \quad \text{(XVI)}$$

where COR represents the coefficient of restitution and 0<COR<1, SC represents the surface coverage in the decimal form of percentage and 0<SC<1, d is the diameter of the golf ball in inches, and w is the weight of the finished golf ball in ounces. The diameter and the weight of the finished golf ball may vary according to the ranges discussed above with respect to formula (VIII).

In some embodiments, the golf balls made in accordance with the present disclosure have a maximum distance of about 95 percent or less of the maximum distance allowed in accordance with USGA-TPX3006, Revision 2.0.0 ("USGA distance rules"). In one embodiment, the maximum distance of a golf ball of the present invention is about 90 percent or less of the maximum distance allowed in accordance with USGA distance rules. In another embodiment, a golf ball of the present invention has a maximum distance of about 85 percent or less of the maximum distance allowed in accordance with USGA distance rules.

In other embodiments, the golf balls made in accordance with the present disclosure achieve a reduction in overall distance of at least about 10 yards when compared to a similar conventional golf ball. In another embodiment, a golf ball of the present invention achieves a reduction in overall distance of at least about 15 yards when compared to a similar conventional golf ball. In still another embodiment, a golf ball of the present invention achieves a reduction in overall distance of at least about 20 yards when compared to a similar conventional golf ball. In yet another embodiment, a golf ball of the present invention achieves a reduction in overall distance of about 25 yards when compared to a similar conventional golf ball.

Golf Ball Construction

Golf balls having various constructions may be made in accordance with the present disclosure. For example, golf balls having two-piece, three-piece, four-piece, and five-piece constructions may be made. The golf balls may contain cores and covers having single or multiple layers. The term, "layer" as used herein means generally any spherical portion of the golf ball. In one embodiment, the golf balls of the present disclosure may be a two-piece golf ball having a core and a cover. In another embodiment, the golf balls of the present disclosure may be a three-piece golf ball having a dual-core (including a center or inner core and a layer disposed thereon) and a cover. In still another embodiment, the golf balls of the present disclosure may be a four-piece golf ball having a dual-core as described above and a dual-cover (including an inner cover and outer cover). In yet another embodiment, the golf balls of the present disclosure may be a five-piece golf ball having a dual-core, intermediate layer, and dual-cover. As used herein, the term, "intermediate layer," refers to a layer of the ball disposed between the core and cover. The intermediate layer may be considered an outer core layer, or inner cover layer, or any other layer disposed between the inner core and outer cover of the ball. The intermediate layer also may be referred to as a casing or mantle layer.

Different materials may be used in the construction of golf balls according to the present disclosure. For example, the cover of the ball may be made of a thermoset or thermoplastic, a castable or non-castable polyurethane and polyurea, an ionomer resin, balata, or any other suitable cover material known to those skilled in the art. In one embodiment, the cover of the ball may be made of a polyurethane. Conventional and non-conventional materials may be used for forming core and intermediate layers of the ball including, for instance, polybutadiene, butyl rubber, and other rubber-based core formulations, ionomer resins, highly neutralized polymers, and the like.

The golf balls of the present disclosure may be formed using a variety of application techniques. For example, the golf ball layers may be formed using compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

What is claimed is:

1. A golf ball comprising:

a core layer comprising a rubber formulation of polybutadiene rubber, butyl rubber, or a blend thereof, and a cover layer comprising a plurality of dimples disposed thereon, wherein the dimples are arranged in an icosahedral pattern comprising twenty substantially identical dimple sections, wherein each dimple section is defined by a spherical triangle, wherein the dimples in each of the twenty substantially identical dimple sections have a corresponding dimple diameter and a corresponding edge angle and the dimples in each of the twenty substantially identical dimple sections comprise:

(i) at least four different dimple diameters including a minimum dimple diameter equivalent to the smallest dimple diameter within the dimple section, a maximum dimple diameter, and at least two additional dimple diameters, wherein each of the at least four different dimple diameters range from about 0.030 inches to about 0.200 inches and the minimum dimple diameter is less than 0.100 inches, and (ii) substantially identical edge angles, wherein each substantially identical dimple section comprises at least one shared dimple located on at least one vertex of the dimple section and the at least one shared dimple has the minimum dimple diameter and a centroid, wherein the centroid of the at least one shared dimple is located on the at least one vertex of the dimple section, wherein the pattern has a surface coverage of about 65 percent or less, and wherein the surface coverage is related to an amount of the rubber formulation according to the following equation:

$$\frac{BR}{1-SC} \leq 2.0$$

where SC is the surface coverage in the decimal form of percentage and 0<SC<1, and BR is the weight percent of polybutadiene rubber, in decimal form, based on the total weight of rubber in the rubber formulation and 0≤BR≤1.

2. The golf ball of claim 1, wherein the rubber formulation comprises a blend of polybutadiene rubber and butyl rubber.

3. The golf ball of claim 1, wherein the rubber formulation comprises a blend of polybutadiene rubber and butyl rubber in a ratio of about 30:70 to about 70:30.

4. The golf ball of claim 1, wherein the golf ball has a coefficient of restitution and the coefficient of restitution is related to the surface coverage according to the following equation:

$$\frac{COR}{1-SC} \leq 1.75$$

where COR is the coefficient of restitution and 0<COR<1, and SC is the surface coverage in the decimal form of percentage and 0<SC<1.

5. The golf ball of claim 1, wherein the pattern results in at least five dimple free great circles on the golf ball.

* * * * *